US005681100A

United States Patent [19]

Powell

[11] Patent Number: 5,681,100

[45] Date of Patent: Oct. 28, 1997

[54] CHEVAL MIRROR WITH CONCEALED STORAGE COMPARTMENT

[75] Inventor: Lawrence Powell, Culver City, Calif.

[73] Assignee: L. Powell Co., Inc., Culver City, Calif.

[21] Appl. No.: 762,610

[22] Filed: Dec. 9, 1996

[51] Int. Cl.[6] ..... A47B 67/00; A47G 1/12

[52] U.S. Cl. ..... 227/337; 312/351.1; 312/226; 248/474

[58] Field of Search ..... 312/227, 204, 312/224, 226, 249.1, 249.7, 351.1; 248/474, 469, 447; 359/872, 854, 855

[56] References Cited

U.S. PATENT DOCUMENTS

| | | | |
|---|---|---|---|
| 799,253 | 9/1905 | Nichols | 312/204 X |
| 3,176,942 | 4/1965 | Mitchell et al. | 312/227 |
| 4,138,083 | 2/1979 | Spiegel | 248/474 |
| 4,304,447 | 12/1981 | Ellwood et al. | 312/204 |
| 4,324,446 | 4/1982 | LeSage | 312/245 |
| 4,776,650 | 10/1988 | Ferenzi | 312/224 X |
| 5,090,784 | 2/1992 | Battista | 312/227 X |
| 5,127,719 | 7/1992 | Battista | 312/227 X |
| 5,368,378 | 11/1994 | Curtis | 312/204 |
| 5,511,873 | 4/1996 | Mech | 312/227 |

FOREIGN PATENT DOCUMENTS

| | | | |
|---|---|---|---|
| 417426 | 1/1947 | Italy | 248/469 |
| 10163 | of 1884 | United Kingdom | 312/226 |
| 7436 | of 1886 | United Kingdom | 248/474 |
| 17173 | 8/1889 | United Kingdom | 248/474 |
| 15255 | of 1890 | United Kingdom | 312/226 |
| 8083 | of 1896 | United Kingdom | 248/474 |
| 235965 | 6/1925 | United Kingdom | 312/226 |

*Primary Examiner*—Peter M. Cuomo
*Assistant Examiner*—Hanh V. Tran
*Attorney, Agent, or Firm*—Daniel R. Kimbell

[57] ABSTRACT

A cheval mirror with concealed storage compartment. The device has a cabinet portion with a rear wall and perimeter side walls to define a space there within and an open front. A mirror door is attached to the cabinet portion with concealed hinges to movably cover the open front of the cabinet portion, thereby defining a mirrored storage compartment. The mirror door seats flush with the cabinet portion when closed, so that it appears integral therewith. The mirrored storage compartment is carried between two upright members extending from a stand portion. The mirrored storage compartment is pivotally attached to the upright members to permit the storage compartment to be tilted. A tilt adjustment control, separate from the pivoting points, is provided to permit the mirrored storage compartment to be adjustably tilted and retained in a plurality of different degrees of tilt relative to the upright members of the stand portion.

21 Claims, 4 Drawing Sheets

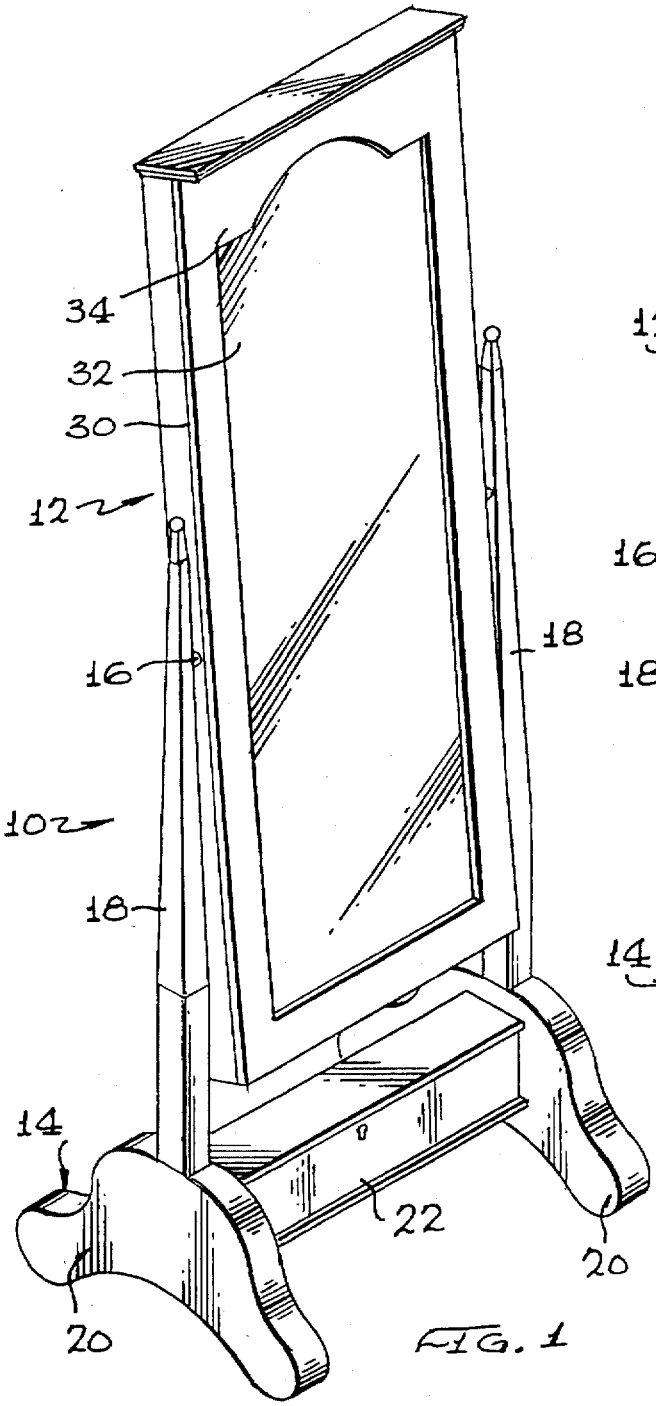
FIG. 1
FIG. 2
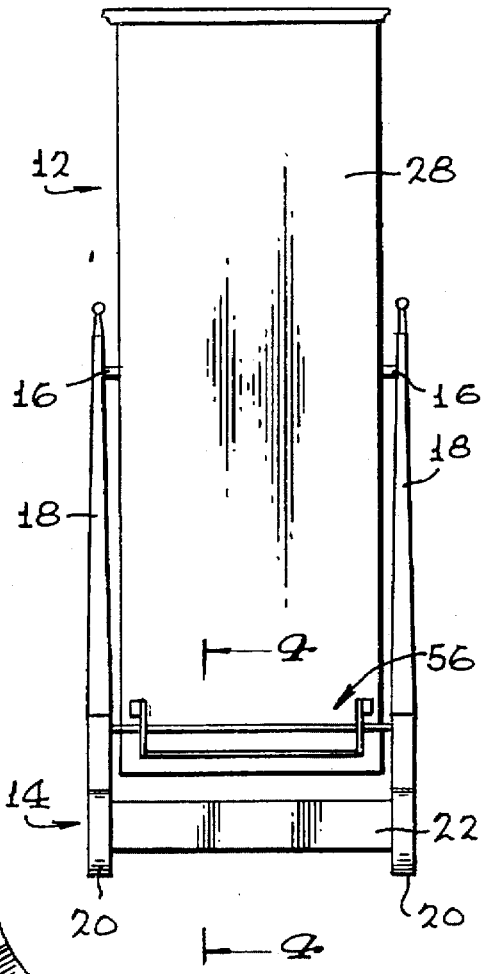

FIG. 3
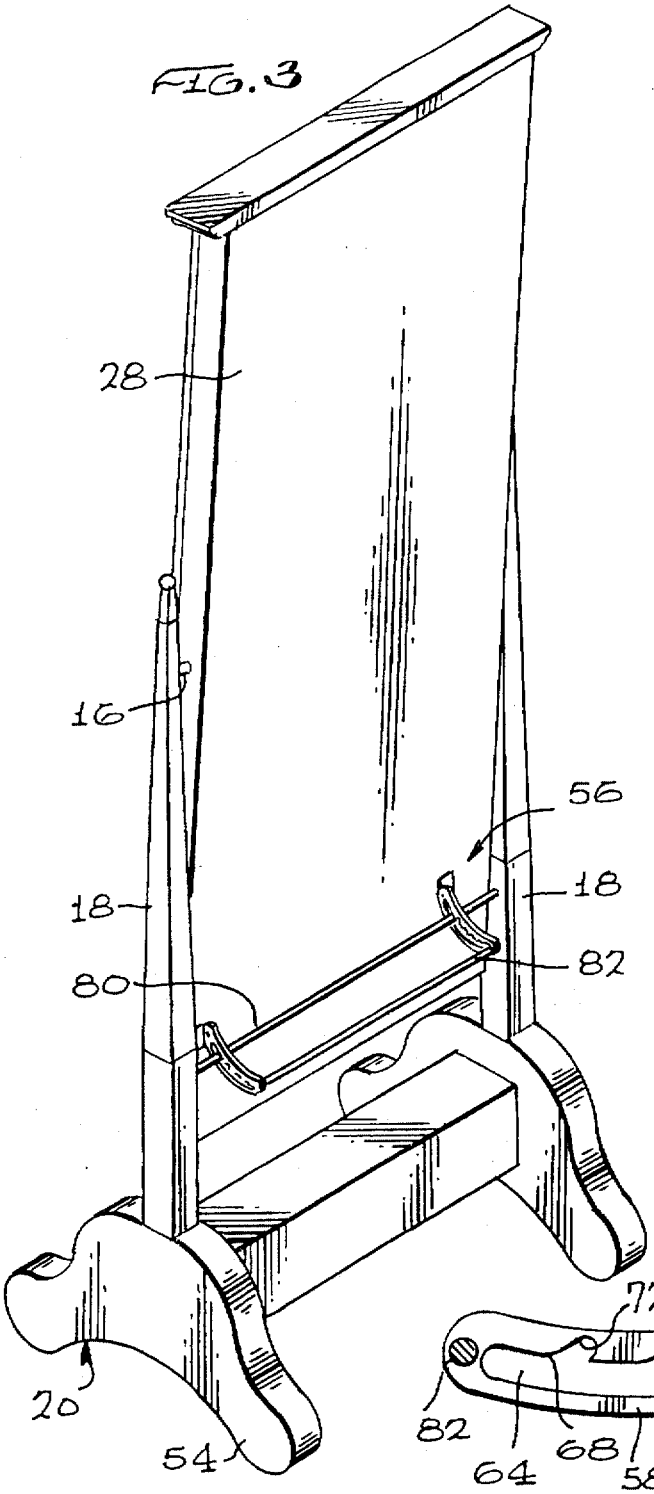
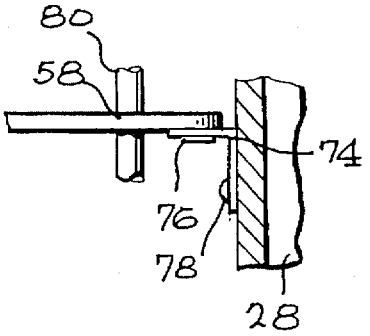
FIG. 5
FIG. 4
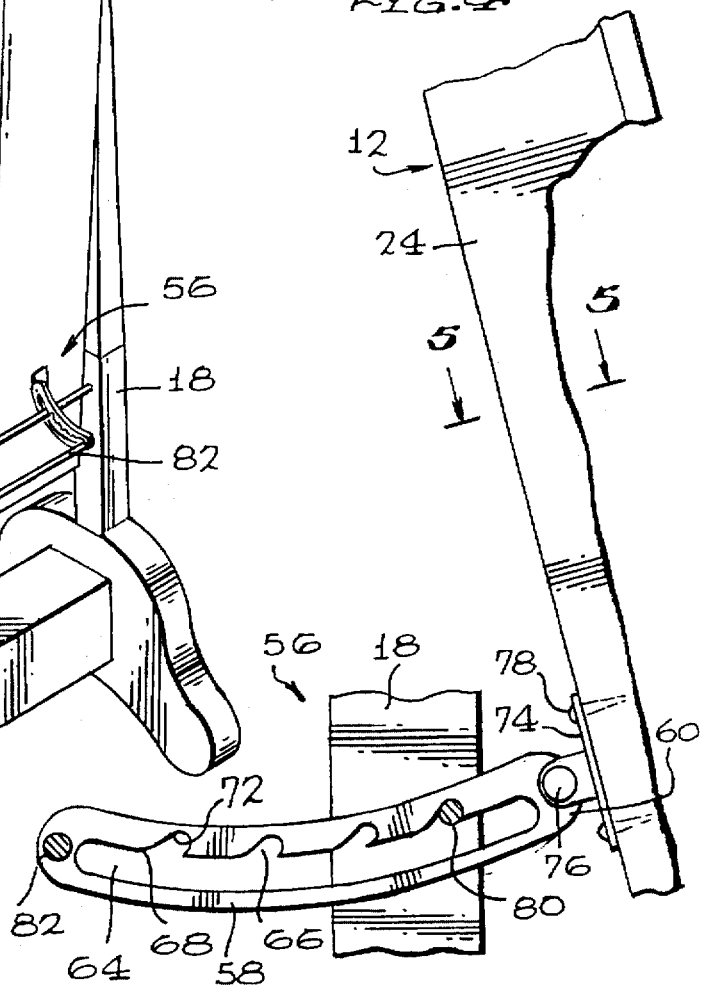

CHEVAL MIRROR WITH CONCEALED STORAGE COMPARTMENT

TECHNICAL FIELD OF THE INVENTION

The invention relates generally to mirrors, and more particularly cheval mirrors with concealed storage compartments.

BACKGROUND OF THE INVENTION

Cheval mirrors have been known since the 1800's, and make an attractive and highly functional addition to a bedroom, dressing room or other room's decor. Cheval mirrors have a framed mirror portion which is pivotally mounted along a horizonal plane between two vertical supports to allow the mirror to be tilted relative to a vertical plane. However, because cheval mirrors can be somewhat large and occupy floor or counter space, some people who would have otherwise liked to have a cheval mirror, choose not to because of space considerations.

All over the world people have become increasingly concerned about the security of their personal property. Many people invest in elaborate home and office security systems and safes. Others resort to storing valuables such as family jewelry in cosmetic jars, foods jars left in cabinets and the refrigerator, or in concealed panels and compartments in their home and office, hoping to thwart potential thieves and burglars.

It would accordingly be ideal to provide a cheval mirror which not only offers the advantages normally associated with cheval mirrors, but which could be utilized to store various relative small and valuable items, such as jewelry and small personal effects, and preferably in a concealed manner, and also in a place when a user is likely to get dressed and choose the jewelry they wish to wear.

BRIEF DESCRIPTION OF THE PREFERRED EMBODIMENT

One object of the invention is to provide a cheval mirror which has a concealed storage compartment for storage of valuables.

Another object of the invention is to provide a cheval mirror which has a tilt adjustment control to allow the mirror to be set and retained at a number of desired degrees of tilt.

Yet another object of the invention is to provide a cheval mirror which has a concealed storage compartment with various dividers and storage features therein including shelves, hooks, bars, straps, and pouches to hold a variety of items.

These and other aspects of the invention are provided by the cheval mirror with concealed storage compartment of the invention. It has an open cabinet portion with a space therewithin and an open from, and a mirror door portion hinged to the open cabinet portion and movably covering the open front of the cabinet portion. The open cabinet portion and mirror door portion form a storage compartment. The storage compartment is pivoted to upright members of a stand to permit the storage compartment to be tilted. The mirror door portion is adapted to cover the open from of the cabinet when in a closed position, and to allow access to the open cabinet portion when in an open position.

BRIEF DESCRIPTION OF THE DRAWINGS

FIG. 1 is a front perspective view a preferred embodiment of the cheval mirror with concealed storage compartment.

FIG. 2 is a rear view of the embodiment of FIG. 2.

FIG. 3 is a rear perspective view of the embodiment of FIG. 1

FIG. 4 is a detail showing the adjustment bracket.

FIG. 5 is a view through view lines 5—5 of FIG. 4

DETAILED DESCRIPTION OF THE INVENTION

Figure 6:
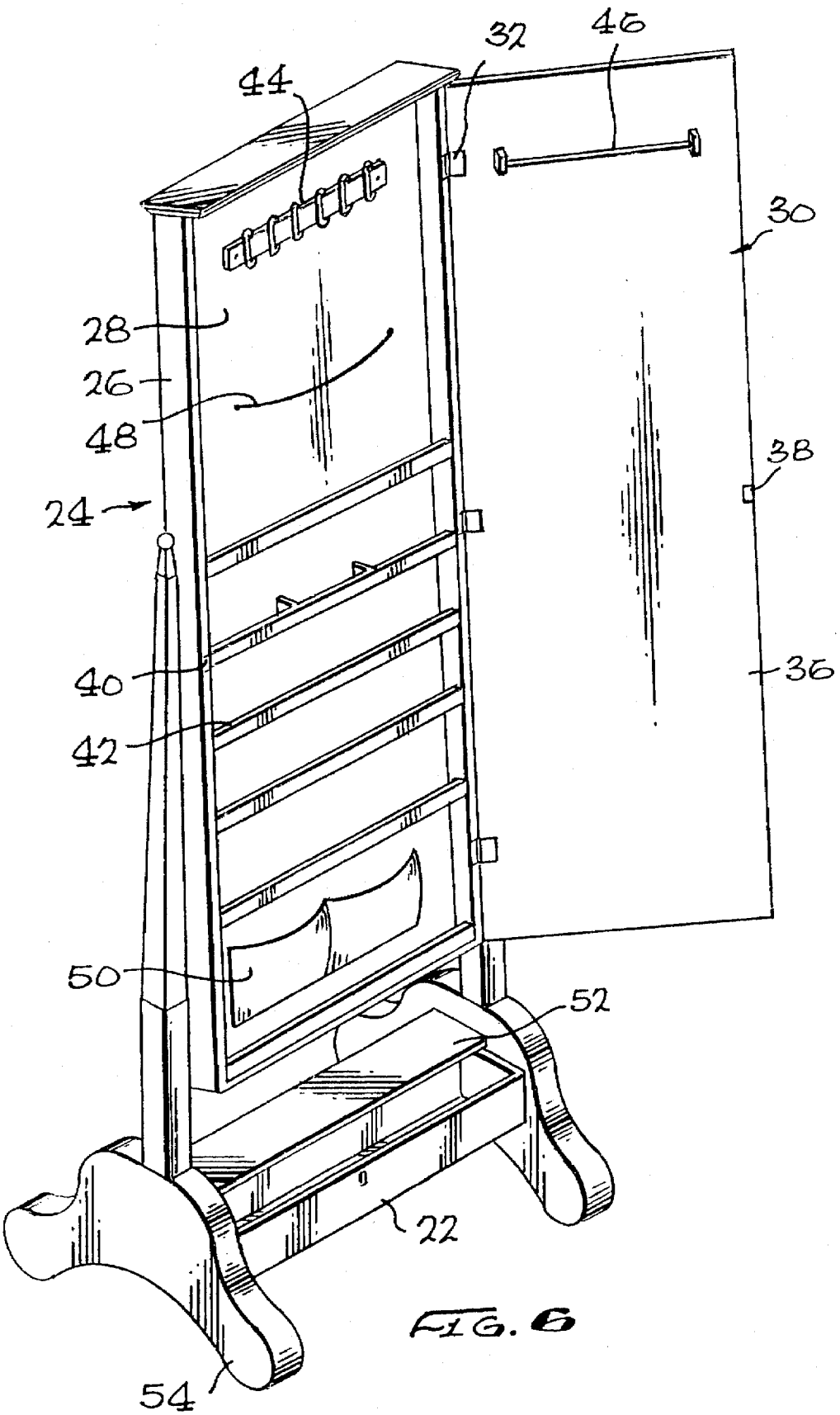
FIG. 6 is an front perspective view cheval mirror showing its concealed compartment and drawer in their open position.

Referring to FIGS. 1, 2 and 6, the cheval mirror with concealed storage compartment 10 of the invention is shown. The invention includes a mirrored storage compartment 12 and a stand portion 14. The mirrored storage compartment 12 is pivotally attached with pivot pins 16 to two uprights or posts 18 which extend up from a base portion 20 of the stand portion 14. The pivot pins 16 can be threaded and screwed into the mirrored storage compartment 12 to provide for adjustability, so that the looseness between the mirrored storage compartment 12 and the uprights 18 can be adjusted. A drawer 22 can optionally be provided in the stand portion 14 for additional, non-concealed storage of items.

Referring to FIG. 6, the mirrored storage compartment 12 has a cabinet portion 24 with perimeter side walls 26 extending from a rear wall 28. A mirrored door 30 is preferably hinged to the cabinet portion 24 with concealed hinge means 32, which can comprise, for example, multiple hinges or a single piano type hinge. Referring to FIG. 1, the mirrored door 30 has a glass mirror 32 in a frame 34. The back of the glass mirror 32 is covered with a rear frame wall 36. The mirrored door 30 is sized to rest snugly adjacent the perimeter side walls 26 so that the when mirror door 30 is closed, as is shown in FIG. 1, the mirrored door 30 appears to be permanently attached to the cabinet portion 24 and forming a closed enclosure for the glass mirror 32, as is the case with conventional cheval mirrors. Latching means 38 on the mirror door 30 and complementary latching means 40 on the cabinet portion 24, such as a magnetic clasp and metal plate, or other known means are preferably provided to retain the mirrored door 30 in its closed orientation relative to the cabinet portion 24 as shown in FIG. 1. The latching means 38 and 40 are preferably not seen when the mirror door 30 is closed. The other known latching and locking means can be provided such as key locks and the like. Preferably located within the mirrored storage compartment 12 are various means to hold items therein, such as shelves 42, hooks 44 and bars 46 for hanging chains and the like, retention straps 48, and pouches 50. The inclusion of any particular of the various storage accessories and their number are a matter of design choice, and can be varied as desired. The drawer 22 fits within a box 52 positioned between the two leg supports 54 of the stand portion 20 which rest on the floor. The box 52 ties the two leg supports 54 together. Alternately, the drawer 22 and box 52 can be left out, and replaced with other means to connect the leg supports 54 together, such as one or more panels of wood or material (not shown).

Turning now to FIGS. 3–5, a tilt adjustment mechanism 56 to adjust and retain the mirrored storage compartment 12 in one of a number of different degrees of vertical tilt relative to the stand 14 is shown. The tilt adjustment mechanism 56 includes a swing arm 58 (and preferably two) with a first end 60 and a second end 62. The swing arm 58 comprises a generally flat section of material, such as metal or plastic, and preferably arches downwardly from its first end 60 to its second end 62. An elongate slot 64 is formed in the swing arm 58 between the first and second ends 60 and 62. A plurality of spaced apart slot extensions 66 extend from the upper edge of elongate slot 64 at an angle directed generally toward the first end 60, and terminate a short distance therefrom. Each of the slot extensions 66 have one side 68 which smoothly slopes from the elongate slot 64 and an opposite side 70 which transitions at an sharp angle with the elongate slot 64, the slot extensions 66 thereby forming capture ends 72. The first end 60 of the swing arm 58 pivotally attached to an L-shaped bracket 74, for example with a pivot pin or loose rivet 76. The bracket 74 is affixed with screws 78, nails, or other means to the rear wall 28 of the mirrored storage compartment 24, and pivotally affixes the swing arm 58 in a vertical plane generally perpendicular to the rear wall 28 of the mirrored storage compartment 24. A bar 80, such as made of metal, is positioned in a horizontal position between the two uprights 18. The bar 80 passes through the elongate slot 64 in the swing arms 58, and is sized to slidably fit not only in the elongate slot 58, but also into the slot extensions 66, and seat at the capture ends 72 thereof.

The use of the tilt adjustment mechanism is now described. FIG. 4 shows the tilt adjustment mechanism 56 in its position with the bar 80 in the slot extension 66 closest the first end 60 of the swing arm 58 and attached to the mirrored storage compartment 12, to thereby establish the least amount of tilt of the mirrored storage compartment 12 relative the vertical plane. By pushing the top of the mirrored storage compartment 12 backwards, or pulling the bottom thereof forward, the bar 80 will slide out of the first slot extension 66 and fall into the more rearward slot extension 66. This process can be continued until the desired degree of tilt is achieved, and/or the bar 80 falls in the last slot extension 66. The weight of the swing arms 58 will cause same to naturally come to rest on the bar 80, and the weight and balance of the mirrored storage compartment 12 will cause its bottom to swing down until the bar 80 is captured in one of the slot extension 66. This is due to the pivot pins 16 being placed in the cabinet portion 24 at positions above the center of gravity of the mirrored storage compartment 12 between the top edge and bottom edge thereof. If a user wishes to move the mirrored storage compartment 12 to a position of less tilt, the user will simply need to lift up the swing arms 58 near their second end 62 to thereby release the bar 80 from the slot extensions 66. This allows the bottom of the mirrored storage compartment 12 to swing backwardly, to a more upright position. Referring back to FIG. 3, for ease of use, the pair of swing arms 58 can optionally be connected together with an optional joining member 82 so that both swing arms 58 can be simultaneously lifted at once with a single hand. Also, it is also possible to use a single swing arm 58 in lieu of a pair of swing arms 58.

Figure 8:
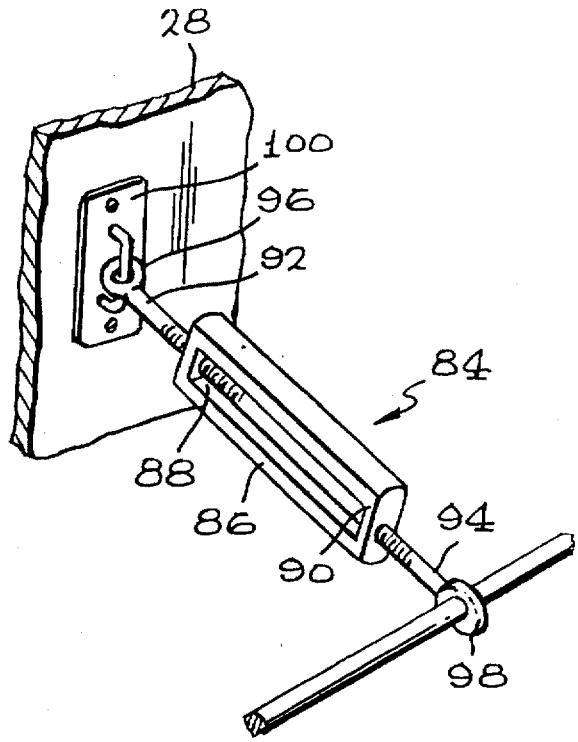
FIG. 8 is a detail of the circled area 8—8 of FIG. 8, showing the tilt adjustment mechanism.
Figure 7:
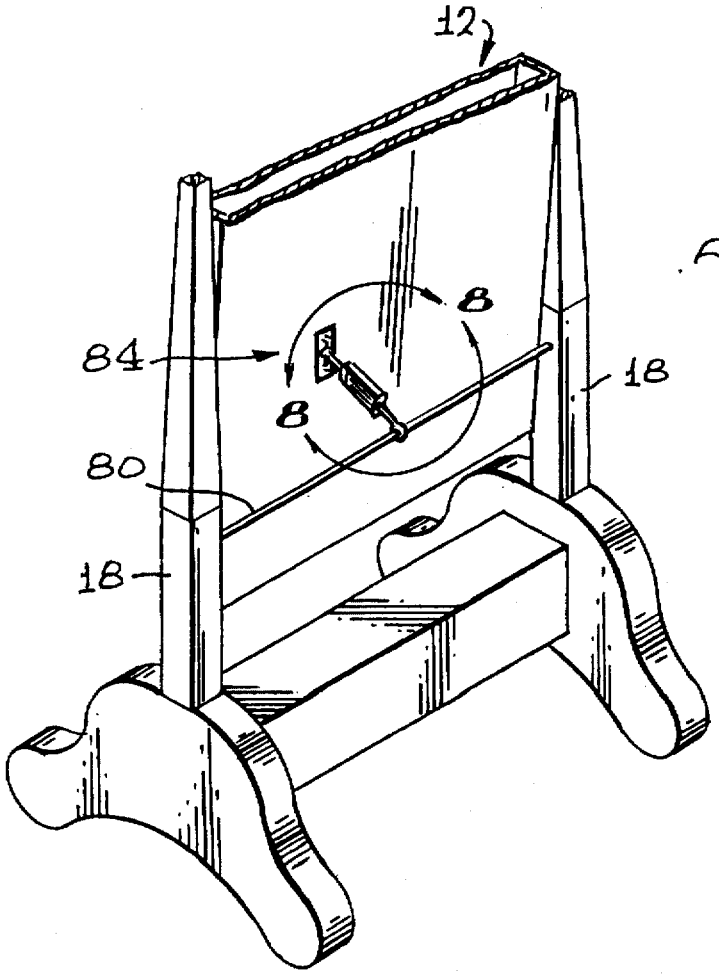
FIG. 7 is a partial rear perspective view showing another embodiment of a tilt adjustment mechanism of the invention.

Referring to FIGS. 7 and 8, another embodiment of a tilt adjustment means 84 is shown. This embodiment utilizes a turnbuckle body 86 which is threaded at both ends 88 and 90 with opposite thread patterns, one clockwise, and one counter-clockwise. Eye screws 92 and 94 with opposite screw threads and rings 96 and 98 at their ends are threaded into the threaded ends 88 and 90 of the turnbuckle body 86, so that when the turnbuckle body 86 is rotated, both eye screws 92 and 94 will either be drawn into or screw out of the turnbuckle body 86. A bar 80 spanning the two uprights 18 will pivotally pass through the ring end 98 of eye screw 94, and the ring end 96 of eye screw 92 will be pivotally attached to a bracket 100 attached to the rear wall 28 of the mirrored storage compartment 12. A user will thus be able to easily adjust the angle of tilt of the mirrored storage compartment by simply rotating the turnbuckle body 86 and will be able to achieve a wide range of precise degrees of tilt.

The particular shape and ornamentation the stand 14 and mirrored storage compartment 12 can take are left up to the desires of the designer, and can be made of a variety of material such as various woods in a variety of finishes, plastics, composites or even metal.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A cheval mirror with concealed storage compartment, comprising:

a cabinet portion with a space therewithin and an open front;

a mirror door portion movably covering the open from of the cabinet portion, the cabinet portion and mirror door portion forming a mirrored storage compartment;

a stand portion with a base and upright members; and pivoting means pivotally attaching the mirrored storage compartment to the upright members to permit the mirrored storage compartment to be tilted; wherein the mirror door portion is adapted to cover the open front of the cabinet portion when in a closed position, and to allow access to the cabinet portion when in an open position.

2. The cheval mirror of claim 1, wherein the cabinet portion comprises a rear wall with perimeter side walls.

3. The cheval mirror of claim 2, wherein the mirror door portion is attached with concealed hinge means to a portion of the perimeter side walls of the cabinet portion and rests adjacent the perimeter side walls when the mirror door portion is in a closed position, so that the mirror door portion appears integral with the cabinet portion.

4. The cheval mirror of claim 1, wherein the pivoting means pivotally attaching the mirrored storage compartment to the upright members to permit the mirrored storage compartment to be tilted comprises pins pivotally attaching upper ends of the upright portions to the side walls the cabinet members.

5. The cheval mirror of claim 4, wherein the pins pivotally attaching upper ends of the upright members to the side walls attach to side edges of the cabinet portion between a top edge and a bottom edge of the cabinet portion at a point above the center of gravity between the top edge and the bottom edge of the cabinet portion of the storage compartment.

6. The cheval mirror of claim 1, further comprising tilt adjustment means to permit the mirrored storage compartment to be adjustably tilted and retained in a plurality of different degrees of tilt relative to the upright members of the stand portion.

7. The cheval mirror of claim 6, wherein the tilt adjustment means is distinct from the pivoting means and is located substantially below the pivoting means.

8. The cheval mirror of claim 6, wherein the tilt adjustment means comprises:

a swing arm with a first end and a second end, an elongate slot formed in the swing arm between the first and second ends, a plurality of spaced apart slot extensions extending from the elongate slot at an angle generally directed upwardly and toward the first end, the slot extensions having terminating capture ends, the first end of the swing arm being pivotally attached to the rear wall of the cabinet portion; and a bar extending from at least one of the upright members of the stand, the bar being adapted to extend through the elongate slot in the swing arm and to be captured in one of the capture ends of the slot extensions when the second end of the swing arm pivots downwardly, wherein the mirrored storage compartment can be tilted from a most upright position to a most tilted position until the bar is captured in the slot extension nearest the second end of the swing arm by moving a top of the mirrored storage compartment rearward, and to decrease the degree of tilt, the second end of the swing can be lifted upwardly, to permit the bar to slid in the elongate slot portion toward the first end of the swing arm, until the bar is captured in another slot extension or the end of the elongate slot closest the first end of the swing arm.

9. The cheval mirror of claim 8, wherein a pair of the swing arms are provided and the bar extends between the upright members which straddle the storage cabinet.

10. The cheval mirror of claim 8, wherein the bar extends between and spans the stand portion.

11. The cheval mirror of claim 6, wherein the tilt adjustment means comprises:

a turnbuckle body threaded at opposite ends, one end being threaded clockwise, and one end being threaded counter-clockwise;

a pair of eye screw with ring ends, one being threaded clockwise and one being threaded counter-clockwise;

a bracket affixed to a rear wall of the mirrored storage compartment and pivotally attached to the ring end of one eye screw; and a bar spanning the upright members and pivotally passing through the ring end of the other eye screw, and wherein the eye screws are threaded into the threaded ends of the turnbuckle body, so that when the turnbuckle body is rotated, both eye screws will either be drawn into, or screw out of the turnbuckle body, changing the effective overall length of the turnbuckle, and affecting changes in the tilt of the mirrored storage compartment relative to the upright members.

12. The cheval mirror of claim 1, wherein the base of the stand portion has a pair of leg supports, with a drawer positioned between the leg supports.

13. The cheval mirror of claim 1, further comprising means within the mirrored storage compartment to hold a variety of items therein including at least one of shelves, hooks, bars, straps, and pouches.

14. A cheval mirror with concealed storage compartment, comprising:

a cabinet portion with a rear wall and perimeter side walls defining a space therewithin and with an open front;

a mirror door portion movably covering the open front of the cabinet portion, the open cabinet portion and mirror door portion forming a mirrored storage compartment;

a stand portion with a base and upright members; and pivoting means pivotally attaching the mirrored storage compartment to the upright members to permit the storage compartment to be tilted; and tilt adjustment means to permit the mirrored storage compartment to be adjustably tilted and retained in a plurality of different degrees of tilt relative to the upright members of the stand portion, said tilt adjustment means being distinct from the pivoting means and being located substantially below the pivoting means.

15. The cheval mirror of claim 14, wherein the tilt adjustment means comprises;

a swing arm with a first end and a second end, an elongate slot formed in the swing arm between the first and second ends, a plurality of spaced apart slot extensions extending from the elongate slot at an angle generally directed upwardly and toward the first end, the slot extensions having terminating capture ends, the first end of the swing arm being pivotally attached to the rear of the cabinet portion; and a bar extending from at least one of the upright members of the stand, the bar being adapted to extend through the elongate slot in the swing arm and to be captured in one of the capture ends of the slot extensions when the second end of the swing arm pivots downwardly, wherein the storage compartment can be tilted from a most upright position to a most tilted position until the bar is captured in the slot extension nearest the second end of the swing arm by moving a top of the mirrored storage compartment rearward, and to decrease the degree of tilt, the second end of the swing can be lifted upwardly, to permit the bar to slid in the elongate slot portion toward the first end of the swing arm, until the bar is captured in another slot extension or the end of the elongate slot closest the first end of the swing arm.

16. The cheval mirror of claim 15, wherein the bar extends between and spans the stand portion.

17. The cheval mirror of claim 14, wherein the tilt adjustment means comprises:

a turnbuckle body threaded at opposite ends, one end being threaded clockwise, and one end being threaded counter-clockwise;

a pair of eye screw with ring ends, one being threaded clockwise and one being threaded counter-clockwise;

a bracket affixed to a rear wall of the mirrored storage compartment and pivotally attached to the ring end of one eye screw; and a bar spanning the upright members and pivotally passing through the ring end of the other eye screw, and wherein the eye screws are threaded into the threaded ends of the turnbuckle body, so that when the turnbuckle body is rotated, both eye screws will either be drawn into, or screw out of the turnbuckle body, changing the effective overall length of the turnbuckle, and affecting changes in the tilt of the mirrored storage compartment relative to the upright members.

18. The cheval mirror of claim 14, wherein the mirror door portion is attached with concealed hinges to a portion of the perimeter side walls of the cabinet portion and rests adjacent the perimeter side walls when the mirror door portion is in a closed position, so that the mirror door portion appears integral with the cabinet portion.

19. The cheval mirror of claim 14, wherein the pivoting means attach upper ends of the upright portions to side walls of the attach to side edges of the cabinet portion between a top edge and a bottom edge of the cabinet portion at a point above a center of gravity of the mirrored storage compartment between the top edge and the bottom edge of the cabinet portion.

20. The cheval mirror of claim 14, wherein the base of the stand portion has a pair of leg supports, with a drawer positioned between the leg supports.

21. The cheval mirror of claim 14, further comprising means within the mirrored storage compartment to hold a variety of items therein including at least one of shelves, hooks, bars, straps, and pouches.

* * * * *